United States Patent [19]

McGough

[11] 4,293,015

[45] Oct. 6, 1981

[54] INSULATED BEVERAGE COZY

[76] Inventor: Bonnie McGough, 1104 Teton Ave., Caldwell, Id. 83605

[21] Appl. No.: 158,168

[22] Filed: Jun. 10, 1980

[51] Int. Cl.[3] ..... B65B 11/00

[52] U.S. Cl. ..... 150/52 R; 215/12 H; 215/12 R; 215/100.5; 220/412; 220/449; 220/85 H

[58] Field of Search ..... 150/52 R; 215/12 A, 215/12 R, 13, 100.5; 220/85 H, 411, 412, 413, 449

[56] References Cited

U.S. PATENT DOCUMENTS 2,522,381 9/1950 Kramer ..... 215/12 A
2,685,318 8/1954 Merkle ..... 150/52 R
2,974,814 3/1961 Parsons et al. ..... 215/100.5 X
3,999,653 12/1976 Haigh et al. ..... 220/449 X

*Primary Examiner*—George T. Hall
*Attorney, Agent, or Firm*—Frank J. Dykas

[57] ABSTRACT

An insulated beverage cozy for use with cold drinking utensils such as a twelve ounce beverage can which comprises a cylindrical body open at its top and having a bottom, said cylindrical body having an inner wall and outer wall formed of fabric and fastened together so as to form a plurality of compartments for holding goose down or other insulative materials, and an elastic top band attached to the top of the cylindrical body for holding the beverage cozy snugly to the beverage container.

4 Claims, 3 Drawing Figures

INSULATED BEVERAGE COZY

FIELD OF THE INVENTION

This invention relates to a means for providing an insulated cylindrical jacket for cold beverage cans or similar articles which is both, highly effective in insulating the beverage container so the beverage remains cold, and also, is highly portable in that it is made of fabric and other resilient materials so that it can be readily collapsed and carried in one's pocket.

BACKGROUND OF THE INVENTION

Over the years numerous beverage coasters and jackets have been developed and marketed for the purposes of keeping the beverage container cold or hot and for prohibiting the condensation, which often forms on the outside of a cold container, from being deposited on furniture such as a wooden table.

Those coasters developed for protecting furniture from condensation have particularly stressed the absorbent qualities of the material from which the coaster is formed and/or the water proof seal formed between the top of the coaster and the beverage container.

Those jackets designed for insulating the beverage container have primarily concerned themselves with the use of resilient styrofoam or other materials, of which none are collapsible in the manner that this invention is.

OBJECTS OF THE INVENTION

Accordingly, it is an object of this invention to provide a beverage container jacket which provides both a high degree of insulation for the purposes of keeping the beverage container cold; and secondly, is highly portable in that it is made of materials which are collapsible.

SUMMARY OF THE INVENTION

These objects are achieved by the use of fabic cylinder having disposed therein packets for holding goose down or similar insulative materials.

In this manner a jacket is provided which is both highly effective in insulating the beverage container and is completely collapsible for storage and transportation.

DETAILED DESCRIPTION OF PREFERRED EMBODIMENTS

Figure 1:
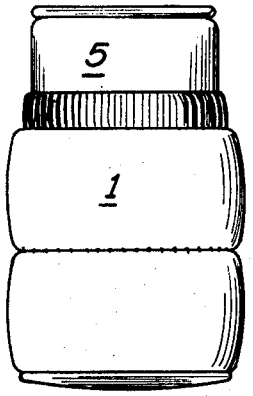
FIG. 1 is a side view.
Figure 2:
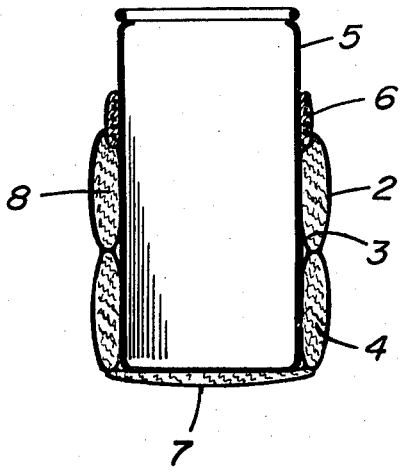
FIG. 2 is a side sectional view.
Figure 3:
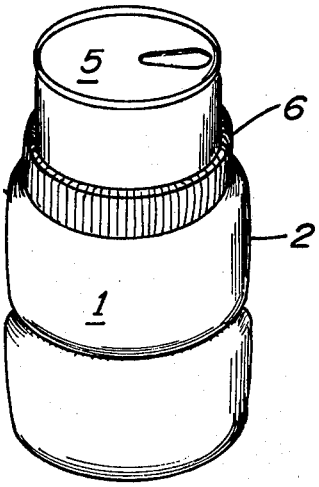
FIG. 3 is a prospective view.

Referring to FIGS. 1, 2 and 3, a cylindrical jacket, collectively identified as 1, is formed of two layers of resilient fabric 2 and 3. The fabric is stitched so as to form bottom chamber 7 and circumferial chambers 4 and 8.

Into these chambers is deposited goose down. The necessity of providing at least two circumferial chambers for the insulated material is to eliminate a shifting or settling of the goose down from top to bottom, which would result in a significant decrease in the insulation properties of the jacket.

Elasticized band 6 is attached to the top opening of the cylindrical jacket and is provided for purposes of holding the jacket snugly to the beverage container.

Having described in detail a preferred design which embodies concepts and principals of the invention and which accomplishes its objects, it is to be appreciated that and will be apparent to those skilled in the art that many minor modifications could be made to this invention without altering the inventive concepts or principals embodied herein. Hence, it is intended that the scope of this invention be limited only to the extent indicated in the appended claims.

I claim:

1. A jacket for use with cold drinking utensils comprising:

a cylindrical body open at its top and having a bottom; and said cylindrical body having an inner and outer wall formed of resilient fabric material fastened together so as to form a plurality of compartments between said inner and outer wall; and insulation material disposed within said compartments formed of resilient fabric; and a circular elastic band attached to the opening of said cylindrical body for snugly fitting around the drinking utensil.

2. The apparatus of claim 1 wherein said insulated material is goose down.

3. A collapsible insulated beverage jacket for use with cold drinking utensils comprising:

a cylindrical body open at its top and having a bottom; and said cylindrical body having an inner and outer wall formed of resilient fabric material fastened together so as to form a plurality of compartments between said inner and outer wall; and insulation material disposed within said compartments formed of resilient fabric; and a circular elastic band attached to the opening of said cylindrical body for snugly fitting around the drinking utensil.

4. The apparatus of claim 3 wherein said insulated material is goose down.

* * * * *